US011849861B2

(12) United States Patent
Chen et al.

(10) Patent No.: US 11,849,861 B2
(45) Date of Patent: Dec. 26, 2023

(54) CHAIR ARMREST

(71) Applicant: ATEC INTERNATIONAL TEAM CO., LTD., Taoyuan County (TW)

(72) Inventors: Te-Chun Chen, Taoyuan County (TW); Fu-Ming Chen, Taoyuan County (TW)

(73) Assignee: ATEC INTERNATIONAL TEAM CO., LTD., Taoyuan County (TW)

( * ) Notice: Subject to any disclaimer, the term of this patent is extended or adjusted under 35 U.S.C. 154(b) by 0 days.

(21) Appl. No.: 17/689,656

(22) Filed: Mar. 8, 2022

(65) Prior Publication Data

US 2022/0322834 A1 Oct. 13, 2022

(30) Foreign Application Priority Data

Mar. 30, 2021 (TW) ..... 110111598

(51) Int. Cl.
*A47C 7/54* (2006.01)

(52) U.S. Cl.
CPC ..... *A47C 7/54* (2013.01); *A47C 7/541* (2018.08)

(58) Field of Classification Search
CPC ..... A47C 7/54; A47C 7/541
USPC ..... 297/411.31, 411.37
See application file for complete search history.

(56) References Cited

U.S. PATENT DOCUMENTS 5,876,097 A * 3/1999 Cao ..... A47C 1/03 297/411.37
6,059,366 A * 5/2000 Hu ..... B60N 2/75 297/411.31
6,106,070 A * 8/2000 Ritt ..... A47C 1/0303 297/411.31
6,948,774 B2 * 9/2005 Maier ..... A47C 1/03 297/411.31
7,159,947 B1 * 1/2007 Lee ..... A47C 1/0308 297/411.37
7,188,907 B1 * 3/2007 Lai ..... A47C 1/03 297/411.37
7,201,449 B2 * 4/2007 Tsai ..... A47C 1/0308 297/411.37 X
7,201,450 B1 * 4/2007 Chen ..... A47C 1/0308 297/411.37
7,387,341 B1 * 6/2008 Tsai ..... A47C 1/0307 297/411.37
9,004,603 B1 * 4/2015 Wang ..... A47C 1/03 297/411.37 X
10,143,310 B1 * 12/2018 Wang ..... A47C 7/541
(Continued)

*Primary Examiner* — Rodney B White
(74) *Attorney, Agent, or Firm* — MUNCY, GEISSLER, OLDS & LOWE, P.C.

(57) ABSTRACT

A chair armrest is revealed. The chair armrest includes an armrest support, an armrest pad body, a connection body, and a connecting member. The armrest pad body has a mounting slot with an opening facing downward while the mounting slot has a depth and a shape. The connection body is provided with a thickness and a shape which are corresponding to the depth and the shape of the mounting slot. Thus the connection body can be mounted and positioned in the mounting slot. The armrest support and the connection body of are connected by the connecting member. During assembly of the chair armrest, the armrest support is connected to the connection body by the connecting member while the armrest pad body is affixed with the armrest support into one part by the connecting member. Thereby production cost is reduced.

16 Claims, 19 Drawing Sheets

(56) References Cited

U.S. PATENT DOCUMENTS

| | | | | |
|---|---|---|---|---|
| 10,165,864 | B1 * | 1/2019 | Su | A47C 1/03 |
| 11,369,204 | B2 * | 6/2022 | Bock | A47C 1/0307 |
| 2004/0130200 | A1 * | 7/2004 | Willette | A47C 1/03<br>297/411.37 |
| 2005/0146192 | A1 * | 7/2005 | Trego | A47C 1/0307<br>297/411.37 |
| 2005/0184574 | A1 * | 8/2005 | Tsai | A47C 1/03<br>297/411.37 |
| 2009/0033139 | A1 * | 2/2009 | Machael | A47C 1/03<br>297/411.37 |
| 2011/0254340 | A1 * | 10/2011 | Hsuan-Chin | A47C 1/0308<br>297/411.31 |
| 2012/0025584 | A1 * | 2/2012 | Chen | A47C 1/03<br>297/411.37 |
| 2014/0145490 | A1 * | 5/2014 | Chen | A47C 1/03<br>297/411.37 |
| 2021/0037981 | A1 * | 2/2021 | Serena | A47C 1/0308 |

* cited by examiner

CHAIR ARMREST

BACKGROUND OF THE INVENTION

The present invention relates to a chair armrest, especially to a chair armrest which solves a problem of armrest pad bodies of chair armrests available now that are only able to be used in combination with limited types of armrest supports.

Refer to FIG. 12 and FIG. 13, a chair armrest 1 available now is composed of an armrest pad 20 assembled with an armrest support 2. The armrest pad 20 is disposed on a top surface 1*a* of the armrest support 2. For assembly, at least two corresponding fastening holes 24 are preset in the assembly of the armrest pad 20 with the armrest support 2 for being assembled and fastened by fasteners such as screws 2*b*. However, once the armrest support 2 is not provided with fasteners or other similar parts used in combination with the fastening holes 24, the armrest pad 20 of the chair armrest 1 available now can only be assembled with limited types of the armrest support. Manufacturers need to develop and produce new armrest pads which is able to be used together with the armrest support which is not provided with fasteners or other similar parts. Thus production cost at the manufacturing end remains high.

Thus there is room for improvement and there is a need to provide a chair armrest in which an armrest pad is able to be used in combination with both an armrest support using fasteners during assembly and an armrest support without using fasteners during assembly.

SUMMARY OF THE INVENTION

Therefore, it is a primary object of the present invention to provide a chair armrest which includes an armrest pad body having a mounting slot with an opening facing downward and a connection body with a thickness and a shape. The mounting slot of the armrest pad body has a depth and a shape while the thickness and the shape of the connection body are corresponding to the depth and the shape of the mounting slot. Thus the connection body can be mounted and positioned in the mounting slot. The armrest support and the connection body of the chair armrest are connected by a connecting member so as to solve the problem of the armrest pad body of the chair armrest available now that is only able to be used in combination with limited types of armrest supports.

In order to achieve the above object, a chair armrest according to the present invention includes an armrest support, an armrest pad body, a connection body, and a connecting member. A top support surface is formed on a top of the armrest support and the armrest pad body is disposed on the top support surface of the armrest support. A mounting slot with an opening facing downward is arranged at a bottom surface of the armrest pad body. The mounting slot having a depth and a shape thereof is composed of an inner bottom surface and a mounting wall surface. The connection body is mounted between the armrest support and the armrest pad body and provided with a thickness and a shape which are corresponding to the depth and the shape of the mounting slot. Thus the connection body can be mounted and positioned in the mounting slot. During assembly of the chair armrest, the armrest support is connected to the connection body by the connecting member while the armrest pad body is affixed with the armrest support into one part by the connecting member. Thereby the problem of the armrest pad body of the chair armrest available now that is only able to be used in combination with limited types of armrest supports can be solved and thus the production cost is decreased.

Preferably, the connecting member includes a first connection portion and a second connection portion which are connected to each other vertically. One of the first connection portion and the second connection portion is disposed on the armrest support while the other is arranged at the connection body and positions of the first connection portion and the second connection portion are corresponding to each other. The first connection portion consists of a fastening head with a thickness along a vertical direction and a fastening neck connected to one side of the fastening head while the second connection portion is provided with a fastening hole and a locking slot which is having a depth in the vertical direction and communicating with an inner side of the fastening hole. A shape and an area of a horizontal cross section of the fastening hole are respectively a bit larger than a shape and an area of a horizontal cross section of the fastening head so that the fastening head can be vertically mounted in the fastening hole and then located in the locking slot. A shape and an area of a horizontal cross section of the locking slot is larger than and including the shape and the area of the horizontal cross section of the fastening head so that the locking slot further includes at least one travel area compared with the fastening head. Thereby the fastening head is able to be rotated horizontally along the respective travel area and further stopped and positioned at a stop position of the respective travel area after vertically mounted into the locking slot. While the fastening hole and the fastening head are aligned with each other vertically, the fastening head is able to be mounted into the locking slot through the fastening hole vertically. Now the fastening head and the fastening hole are in a first assembled state and a lengthwise central axis of the first connection portion and a lengthwise central axis of the top support surface of the armrest support are in a staggered manner horizontally with a staggered angle therebetween. Under the first assembled state, the fastening head is able to rotate horizontally around a vertical central axis of the fastening neck in the locking slot. When the fastening head is rotated the staggered angle in the locking slot and stopped rotating, the fastening head is stopped and positioned at the stop position of the travel area. Now the fastening head and the fastening hole are in a second assembled state. The armrest support and the armrest pad body are assembled and fastened with each other into one part.

Preferably, the first connection portion is integrally projecting from the top support surface of the armrest support while the second connection portion is arranged at the bottom surface of the connection body.

Preferably, the first connection portion is integrally projecting from the bottom surface of the connection body while the second connection portion is disposed on the top support surface of the armrest support.

Preferably, the connecting member includes at least one first connection portion and at least one second connection portion which are aligned and pressed to fit and connect with each other vertically. One of the first connection portion and the second connection portion is mounted to the top support surface while the other is arranged at the connection body and positions of the first and the second connection portions are corresponding to each other. The first connection portion and the second connection portion are respectively a shaft tube provided with a first fastening portion and a sleeve provided with a second fastening portion corresponding to the first fastening portion. The shaft tube and the sleeve are joined together by the first fastening portion fastened with the second fastening portion. The second fastening portion of the sleeve is located at an inner circular surface inside the sleeve.

Preferably, the sleeve further includes a packing member which is mounted to the connection body and located above the sleeve. The packing member has at least two packing sheets. The first fastening portion of the shaft tube is located on one end of the shaft tube. When the first fastening portion and the second fastening portion are fastened with each other, the first fastening portion of the shaft tube is pressed by compressive force of the two packing sheets of the packing member and forced to lock into the second fastening portion.

Preferably, the first connection portion is integrally formed and projecting from the top support surface of the armrest support while the second connection portion is arranged at the bottom surface of the connection body.

Preferably, the first connection portion is mounted on the bottom surface of the connection body while the second connection portion is integrally formed and projecting from the top support surface of the armrest support.

Preferably, the second fastening portion is a locking groove mounted to the inner circular surface, an insertion hole located at the inner circular surface, or a surface at one end of the inner circular surface.

Preferably, the two packing sheets are claw-shaped with an interval between them.

Preferably, the inner bottom surface of the armrest pad body further consists of two fastening holes which are symmetrical to each other, having a distance between them, and provided with openings facing downward.

Preferably, the armrest pad body is composed of an armrest pad and an armrest member.

Preferably, the armrest pad is a soft elastic body formed outside the armrest member by integrally foamed technique.

Preferably, the mounting wall surface of the armrest pad body is further provided with a locking recess and a lateral side of the connection body is provided with a locking member able to be locked and fixed in the locking recess. The connection body is mounted in the mounting slot by the locking member locked and fixed in the locking recess.

DETAILED DESCRIPTION OF THE PREFERRED EMBODIMENTS

A structure and technical features of the present invention are described in details in the following embodiments with reference to related figures and reference signs. The size of the respective components shown in figure is not drawn to scale.

Generally, a chair armrest is fastened and fixed on a right side and a left side of a chair from sitters' view. The lengthwise (forward and backward) direction or widthwise (leftward and rightward, from side to side) direction hereafter are viewed from the sitter.

Figure 1:
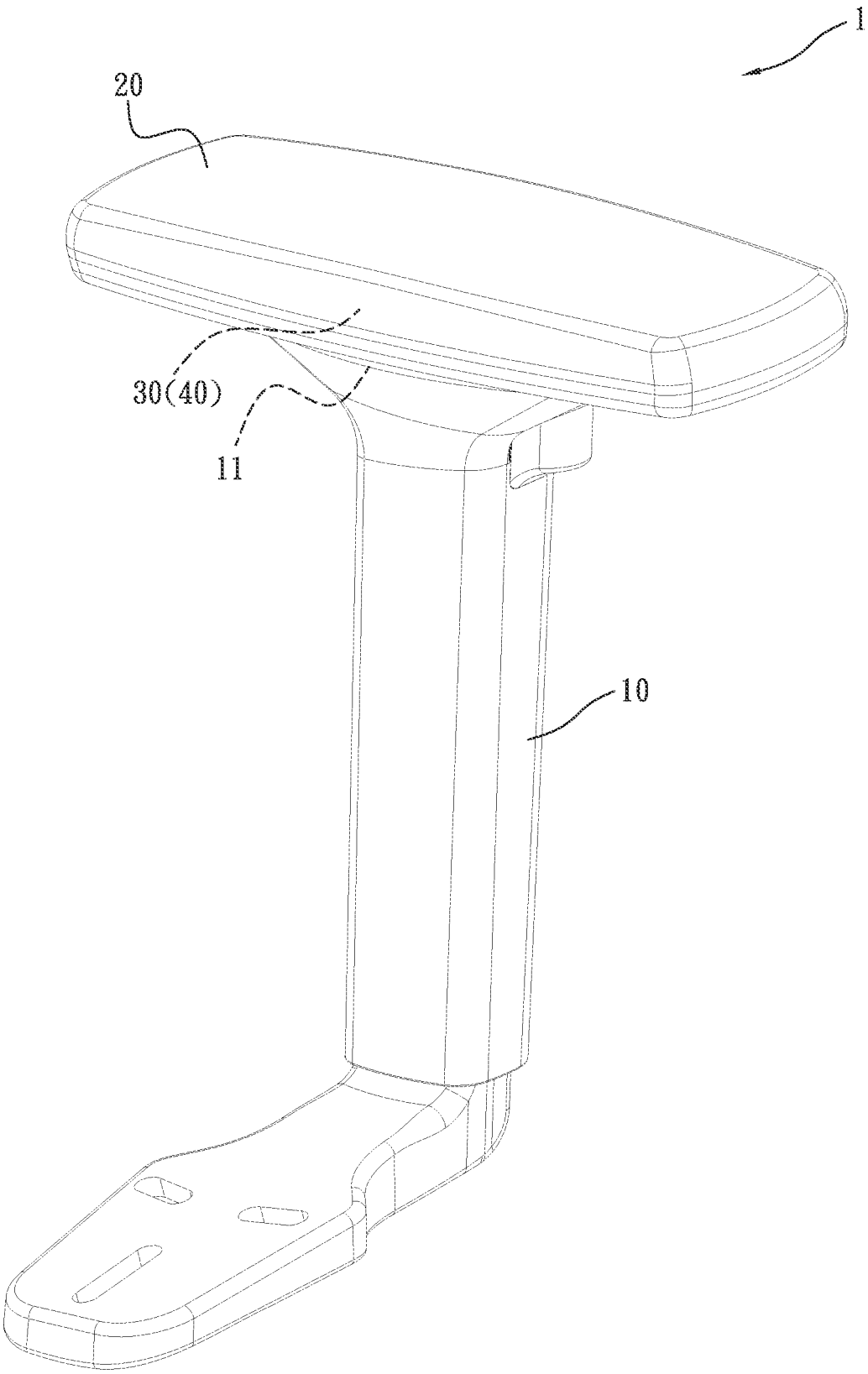
FIG. 1 is a perspective view of an embodiment according to the present invention.
Figure 2:
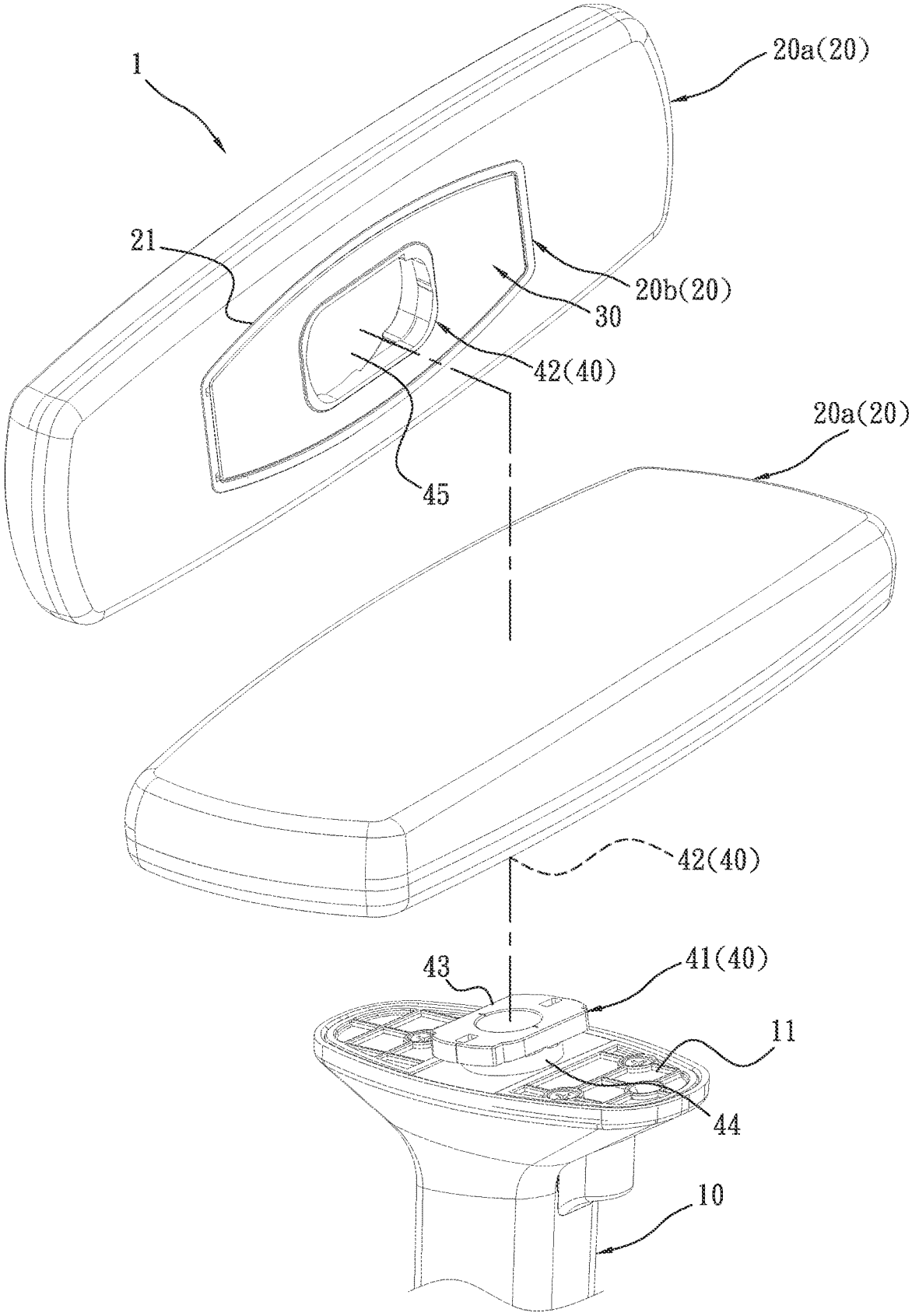
FIG. 2 is an exploded view of the embodiment in FIG. 1 (the first embodiment) being rotated an angle according to the present invention.
Figure 14:
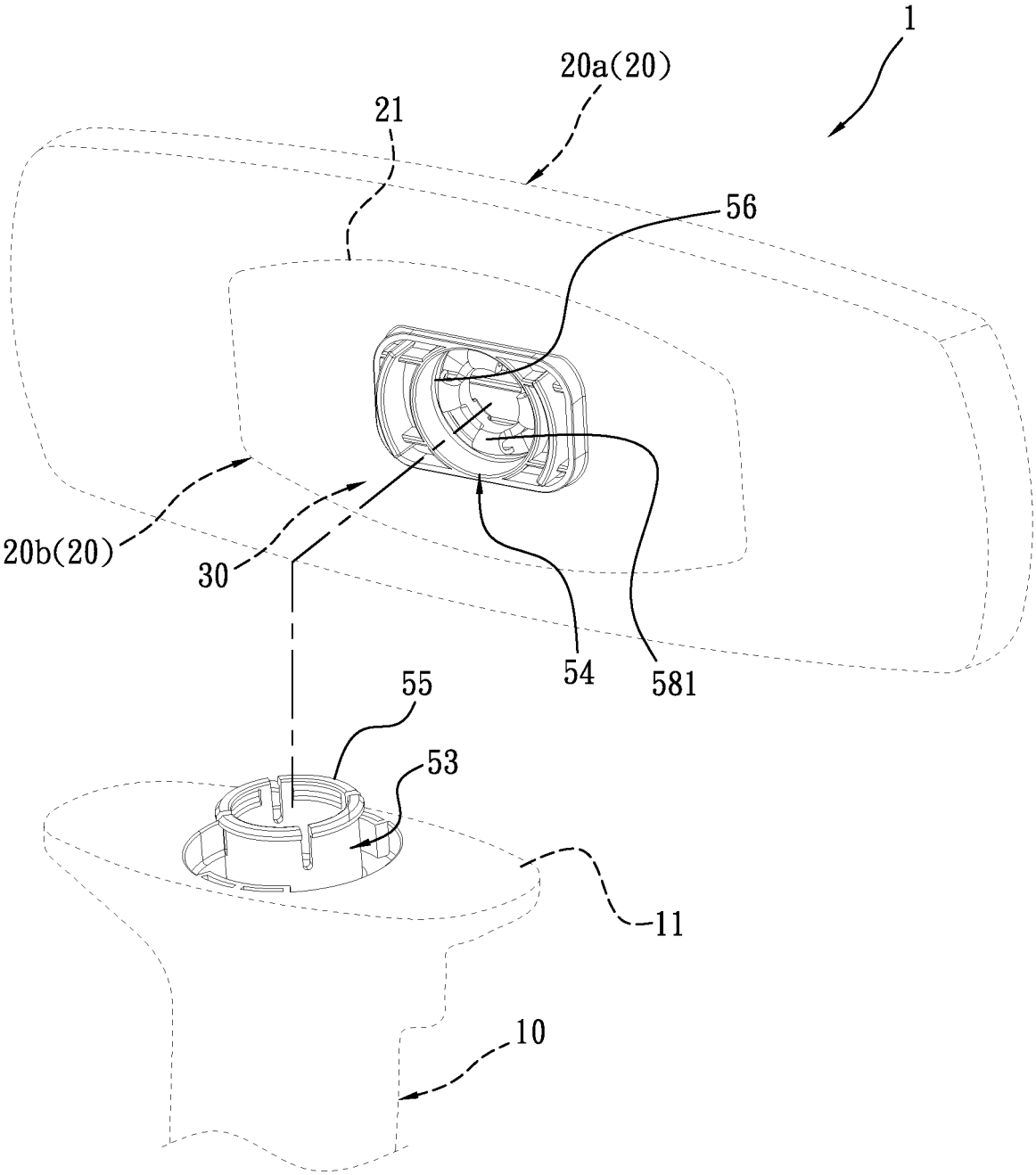
FIG. 14 is a partial exploded view of a connecting member of another embodiment (second embodiment) according to the present invention.
Figure 15:
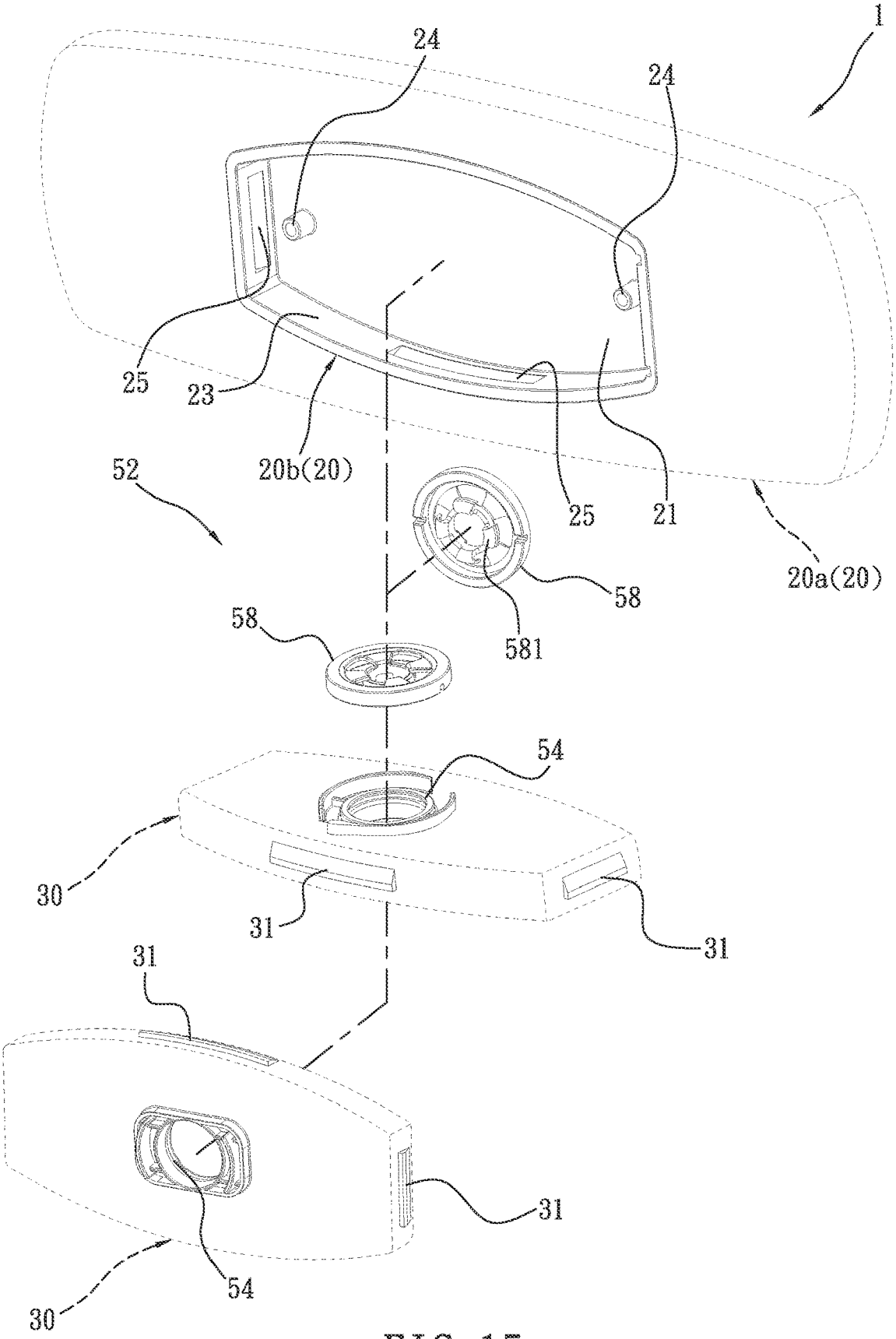
FIG. 15 is a partial exploded view of an armrest pad body and a connection body of another embodiment according to the present invention.

Refer to FIG. 1, FIG. 2, and FIG. 14, an assembled chair armrest 1 according to the present invention includes an armrest support 10, an armrest pad body 20 and a connection body 30. The chair armrest 1 is a basic type armrest which is unable to be rotated, moved forward and backward in a lengthwise direction, or leftward and rightward in a widthwise direction. Such kind of chair armrest 1 is commonly used by the public and having a huge market value. The chair armrest 1 features on a connecting member 40 shown in FIG. 2 or a connecting member 50 shown in FIG. 14. The connecting member 40 and the connecting member 50 which are different are respectively used in the first embodiment and the second embodiment. The structure and technical features of the armrest support 10, the armrest pad body 20 and the connection body 30 in the first embodiment and the second embodiment are about the same.

Figure 3:
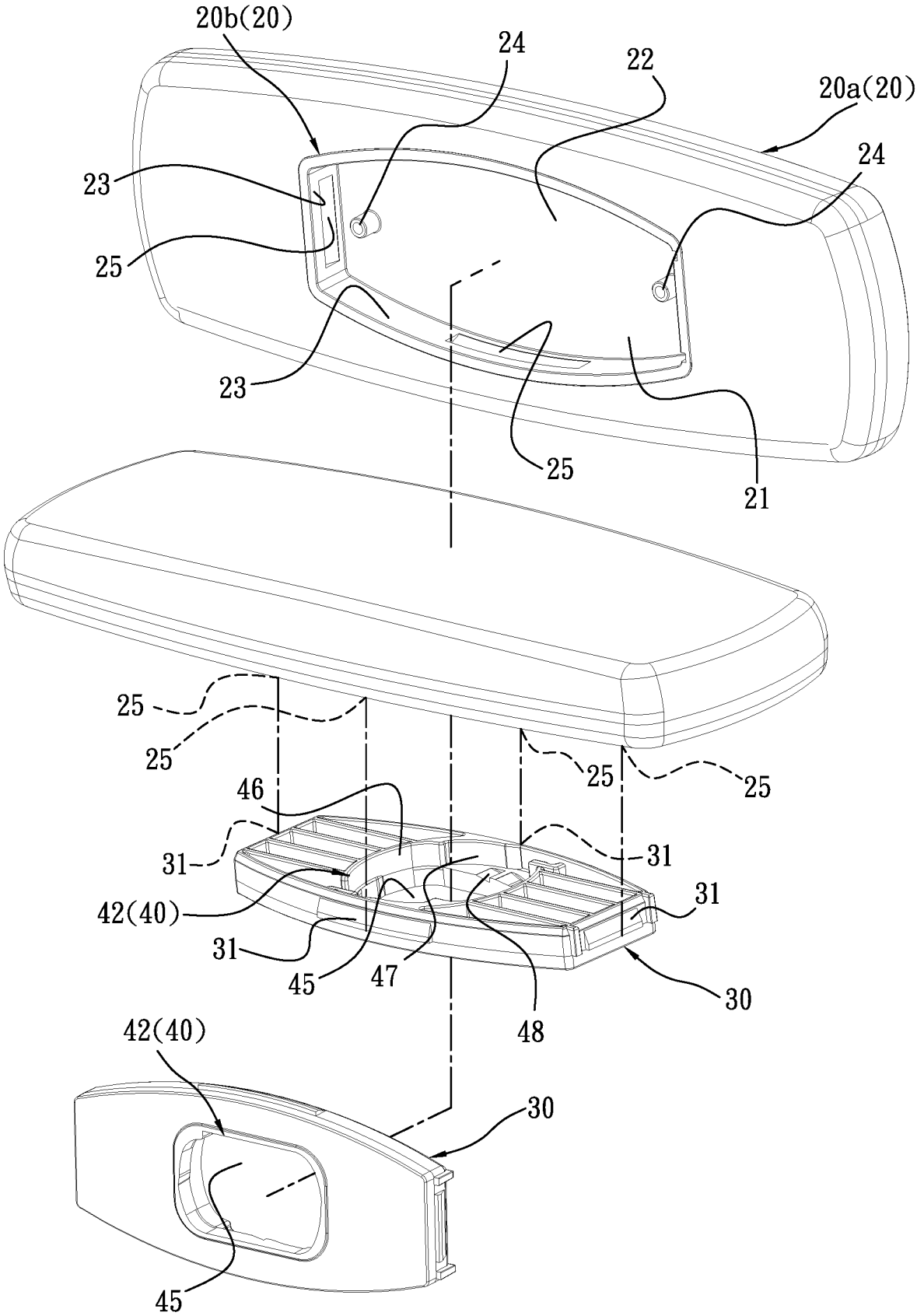
FIG. 3 is an exploded view showing an armrest pad and a connection body of the embodiment in FIG. 2 (the first embodiment) viewed from another angle according to the present invention.
Figure 4:
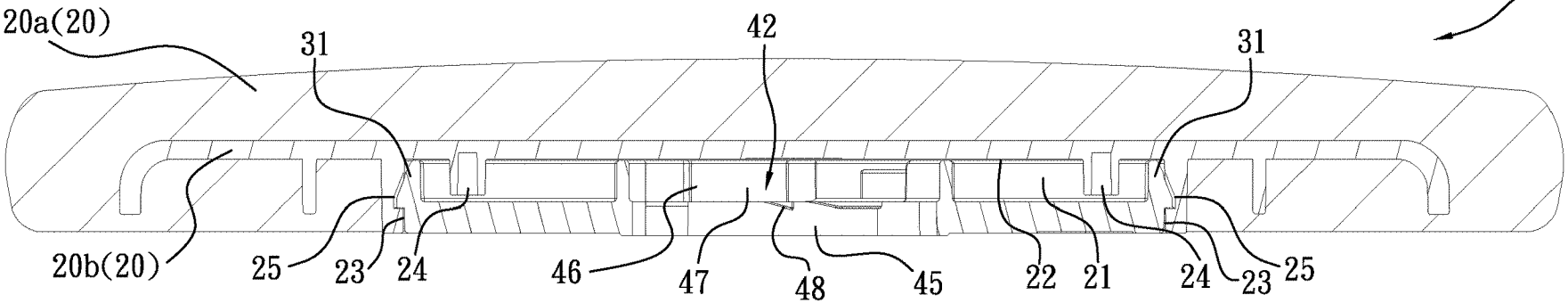
FIG. 4 is a schematic drawing showing a side view of a longitudinal section of an armrest pad and a connection body of the embodiment in FIG. 1 (the first embodiment) according to the present invention.
Figure 5:
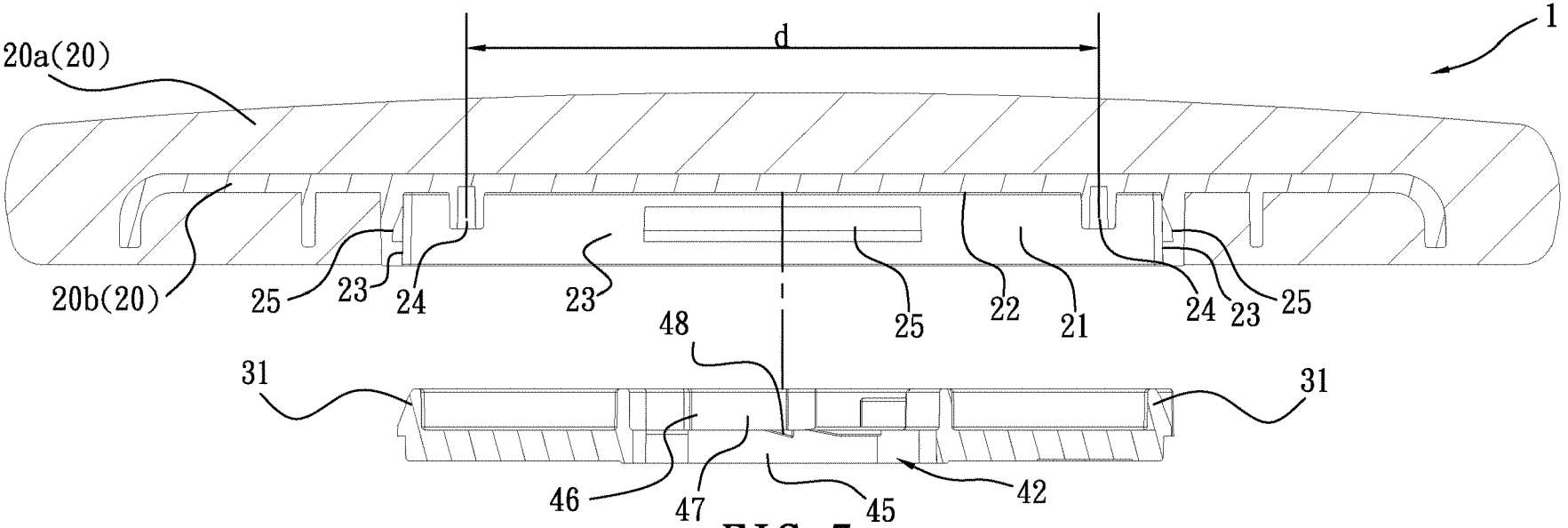
FIG. 5 is a schematic drawing showing an exploded view of the embodiment in FIG. 4 according to the present invention.

Refer to FIG. 1 and FIG. 2, a top support surface 11 is formed on a top of the armrest support 10 and the armrest pad body 20 is disposed on the top support surface 11 of the armrest support 10. A mounting slot 21 with an opening facing downward is arranged at a bottom surface of the armrest pad body 20. The mounting slot 21 having a depth and a shape thereof is composed of an inner bottom surface 22 and a mounting wall surface 23, as shown in FIG. 3-5. The inner bottom surface 22 of the armrest pad body 20 is further including, but not limited to, two fastening holes 24 symmetrical to each other, having a distance d therebetween, and provided with openings facing downward, as shown in FIG. 5 so that the armrest pad body 20 can be fastened and connected with an armrest support available now by screws. The armrest pad body 20 is including, but not limited to, an armrest pad 20*a* and an armrest member 20*b*, as shown in FIG. 4 and FIG. 5. The armrest pad 20*a* is but not limited to a soft elastic body formed outside the armrest member 20*b* by integrally foamed technique. The integrally foamed technique helps fast manufacturing and mass-production. The comfort of the soft and elastic material for the armrest pad 20*a* improves user satisfaction.

Moreover, the mounting wall surface 23 of the armrest pad body 20 is further including, but not limited to, a locking recess 25. A lateral side of the connection body 30 is including, but not limited to, a locking member 31 able to be locked and fixed in the locking recess 25 correspondingly. The connection body 30 is mounted in the mounting slot 21 by the locking member 31 locked and fixed in the locking recess 25 so that locking stability between the respective components is improved.

As shown in FIG. 2, the connection body 30 is disposed between the armrest support 10 and the armrest pad body 20 and having a thickness and a shape which are corresponding to the depth and the shape of the mounting slot 21 of the armrest pad body 20. Thereby the connection body 30 can be mounted and positioned in the mounting slot 21, as shown in FIG. 3-5.

The followings are the first embodiment and the second embodiment with different connecting members.

Figure 6:
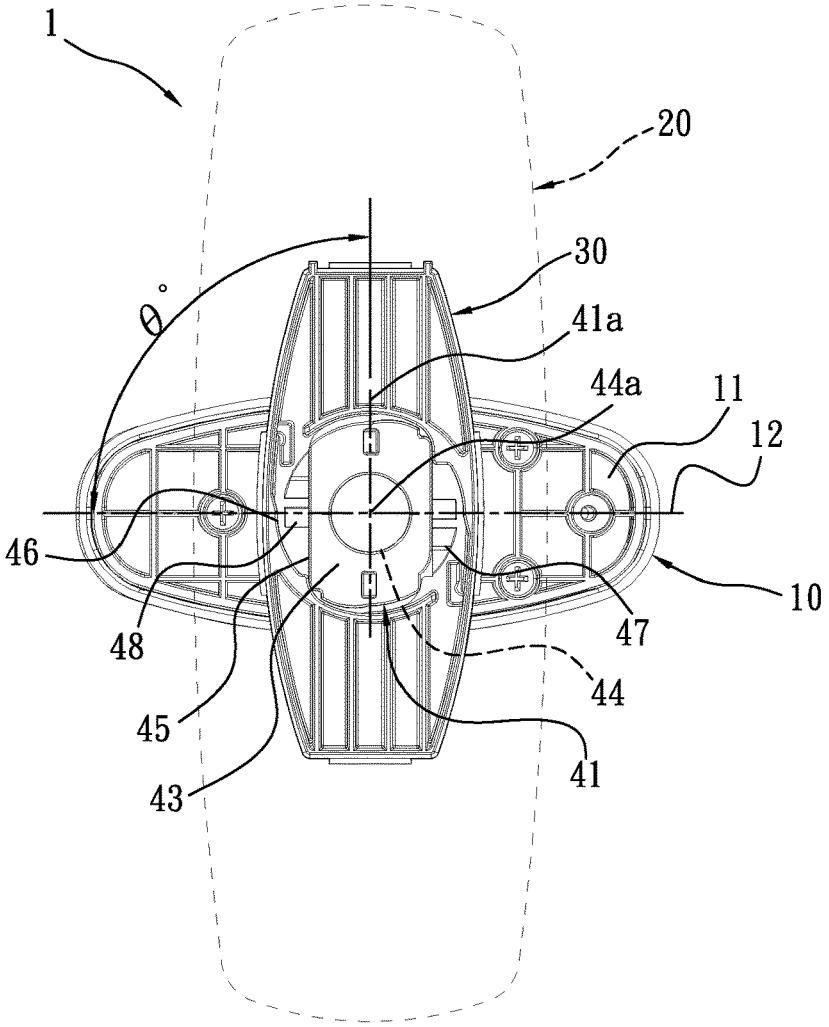
FIG. 6 is a schematic drawing showing a top view of a first connection portion or a second connection portion (of a first embodiment) in a first assembled state according to the present invention.
Figure 7:
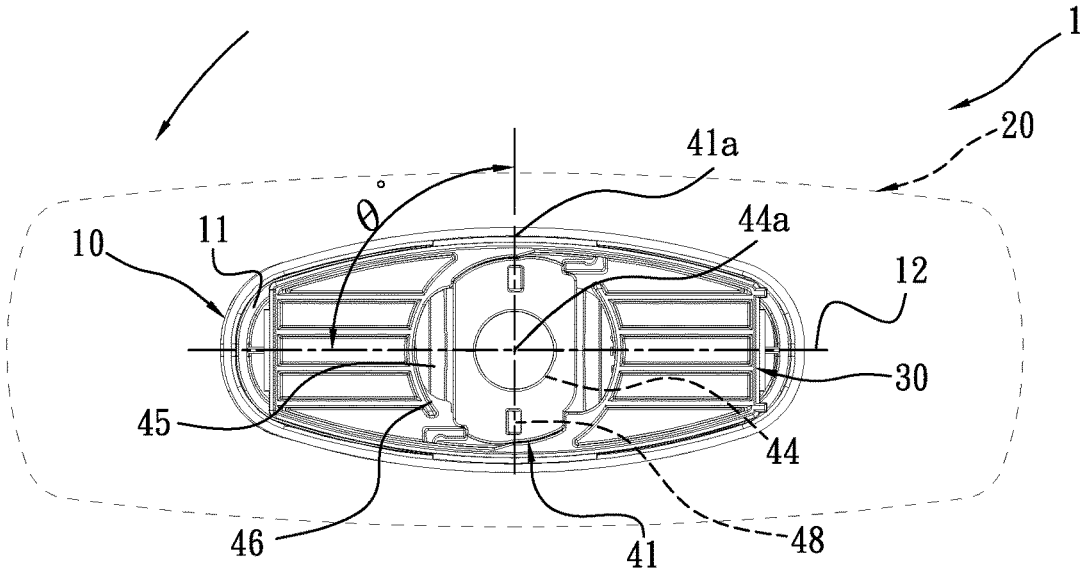
FIG. 7 is a schematic drawing showing a top view of a first connection portion or a second connection portion (of a first embodiment) in a second assembled state according to the present invention.
Figure 8:
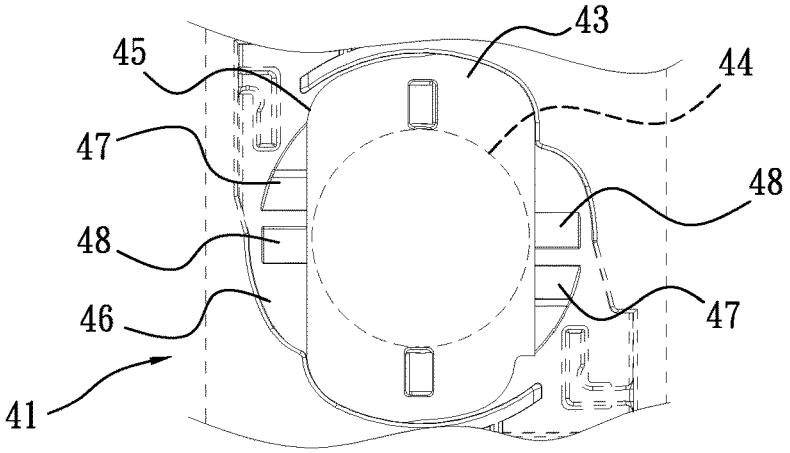
FIG. 8 is a partial enlarged top view of a first connection portion or a second connection portion (of a first embodiment) in a first assembled state according to the present invention.
Figure 9:
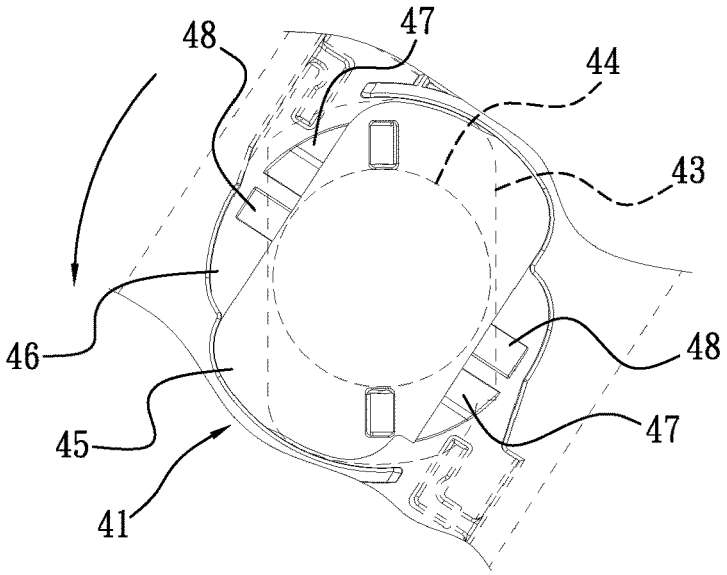
FIG. 9 is a partial enlarged top view showing a fastening head rotated horizontally in a travel area of a first connection portion or a second connection portion (of a first embodiment) according to the present invention.
Figure 10:
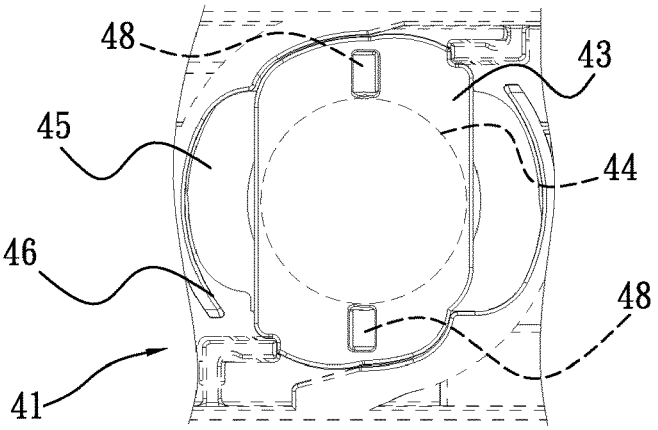
FIG. 10 is a partial enlarged top view of a first connection portion or a second connection portion (of a first embodiment) in a second assembled state according to the present invention.
Figure 11:
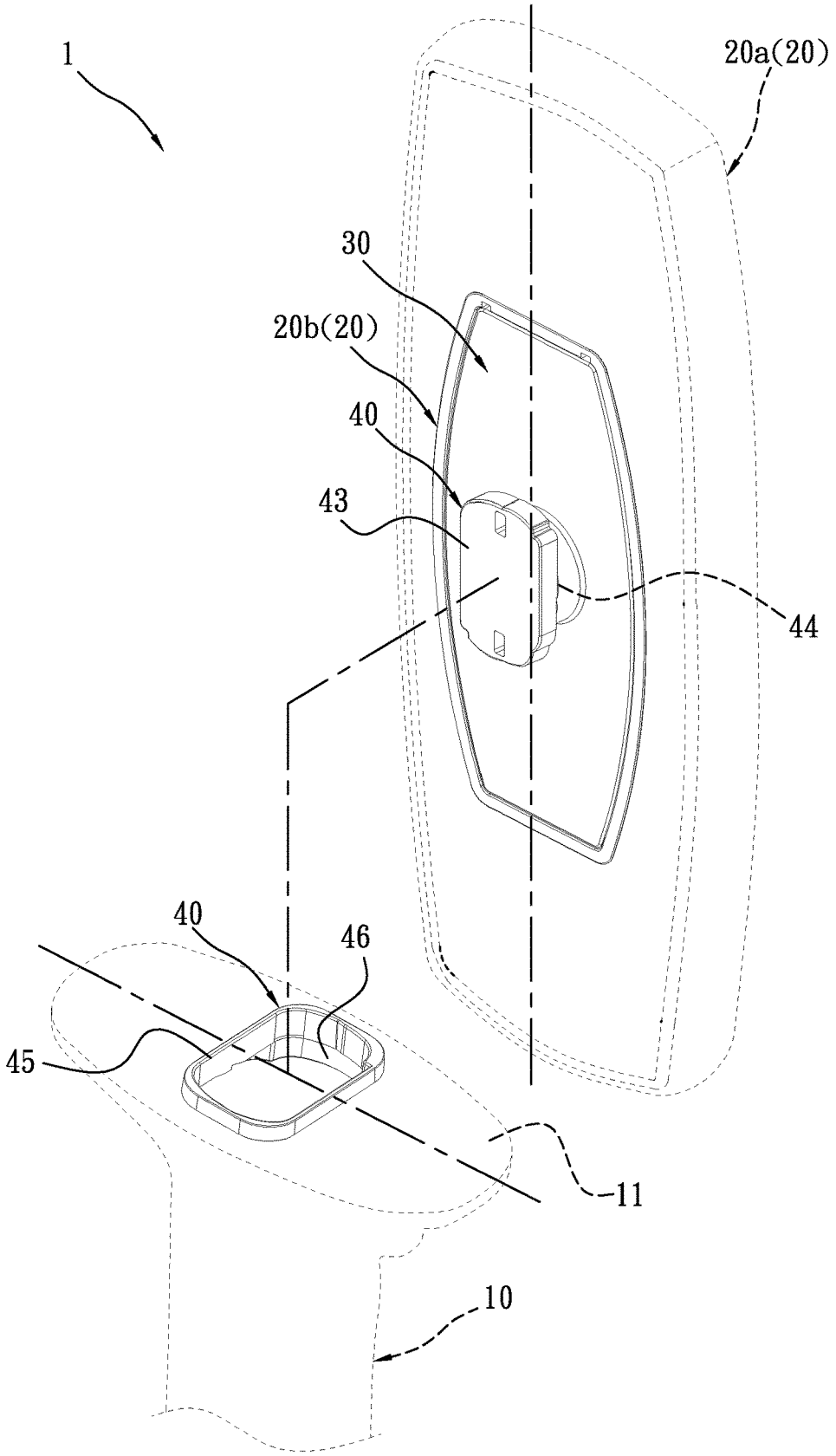
FIG. 11 is another exploded view of the first embodiment in which a fastening hole is aligned with a fastening head according to the present invention.
Figure 22:
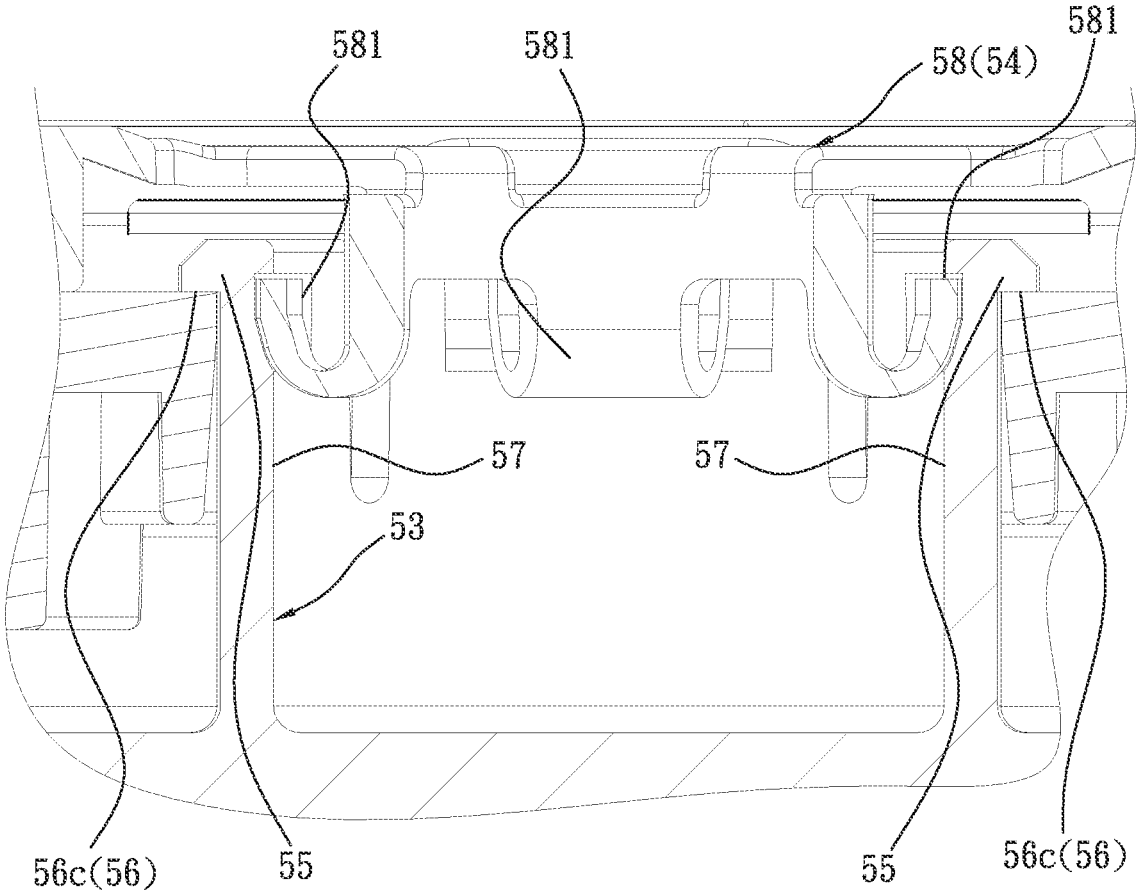
FIG. 22 is a partial enlarged sectional view of the embodiment in FIG. 19 in which a second fastening portion is a surface located at one end of an inner circular surface according to the present invention.

Refer to FIG. 1-11, the first embodiment of the chair armrest 1 is revealed. In this embodiment, the connecting member 40 includes a first connection portion 41 and a second connection portion 42 which are connected to each other vertically. One of the first connection portion 41 and the second connection portion 42 is disposed on the armrest 10 while the other is disposed on the connection body 30 and positions of the first connection portion 41 and the second connection portion 42 are corresponding to each other, as shown in FIG. 2 and FIG. 11. The first connection portion 41 includes a fastening head 43 with a thickness along a vertical direction and a fastening neck 44 connected to one side of the fastening head 43, as shown in FIG. 22 and FIG. 11. As to the second connection portion 42, it consists of a fastening hole 45 and a locking slot 46 which is having a depth in the vertical direction and communicating with an inner side of the fastening hole 45, as shown in FIG. 3 and FIG. 5. A shape and an area of a horizontal cross section of the fastening hole 45 are respectively a bit larger than a shape and an area of a horizontal cross section of the fastening head 43 so that the fastening head 43 can be vertically mounted in the fastening hole 45 and then located in the locking slot 46, as shown in FIG. 8-10. A shape and an area of a horizontal cross section of the locking slot 46 is larger than and including the shape and the area of the horizontal cross section of the fastening head 43 so that the locking slot 46 further includes at least one travel area 47 compared with the fastening head 43. Thereby the fastening head 43 is able to be rotated horizontally (as shown in FIG. 9) along the respective travel area 47 and further stopped and positioned at a stop position 48 (as shown in FIG. 10) of the respective travel area 47 after vertically mounted into the locking slot 46 (as shown in FIG. 8). While the fastening hole 45 and the fastening head 43 are aligned with each other vertically (as shown in FIG. 2 and FIG. 11), the fastening head 43 is able to be mounted into the locking slot 46 through the fastening hole 45 vertically. Now the fastening head 43 and the fastening hole 45 are in a first assembled state, as shown in FIG. 6 and FIG. 8. As shown in FIG. 6, while in the first assembled state, a lengthwise central axis 41*a* of the first connection portion 41 and a lengthwise central axis 12 of the top support surface 11 of the armrest support 10 are in a staggered manner horizontally with a staggered angle θ therebetween. As shown in FIG. 9, under the first assembled state, the fastening head 43 is able to rotate horizontally around a vertical central axis 44*a* of the fastening neck 44 in the locking slot 46. When the fastening head 43 is rotated the staggered angle θ in the locking slot 46 and stopped rotating, unable to be rotated any more, the fastening head 43 is stopped and positioned at the stop position 48 of the travel area 47. Now the fastening head 43 and the fastening hole 45 are in a second assembled state, as shown in FIG. 7 and FIG. 10. The armrest support 10 and the armrest pad body 20 are fastened with each other into one part.

While being assembled into the chair armrest 1, the armrest support 10 and the connection body 30 are connected to each other by vertical connection of the first connection portion 41 with the second connection portion 42. As shown in FIG. 2 and FIG. 11, the armrest pad body 20 is assembled and affixed with the armrest support 10 into one part by the connection body 30.

Moreover, the first connection portion 41 and the second connection portion 42 can be arranged at either the armrest support 10 or the connection body 30 according to user's needs. In the embodiment shown in FIG. 2, the first connection portion 41 is integrally projecting from, but not limited to, the top support surface 11 of the armrest support 10 while the second connection portion 42 is disposed on, but not limited to, the bottom surface of the connection body 30.

As to the embodiment shown in FIG. 11, the first connection portion 41 is integrally projecting from, but not limited to, the bottom surface of the connection body 30 while the second connection portion 42 is disposed on, but not limited to, the top support surface 11 of the armrest support 10. Thereby the present device has much more various manufacturing applications. Except the positions of the first connection portion 41 and the second connection portion 42, the rest structure and technical features of the above two embodiments are about the same.

Figure 16:
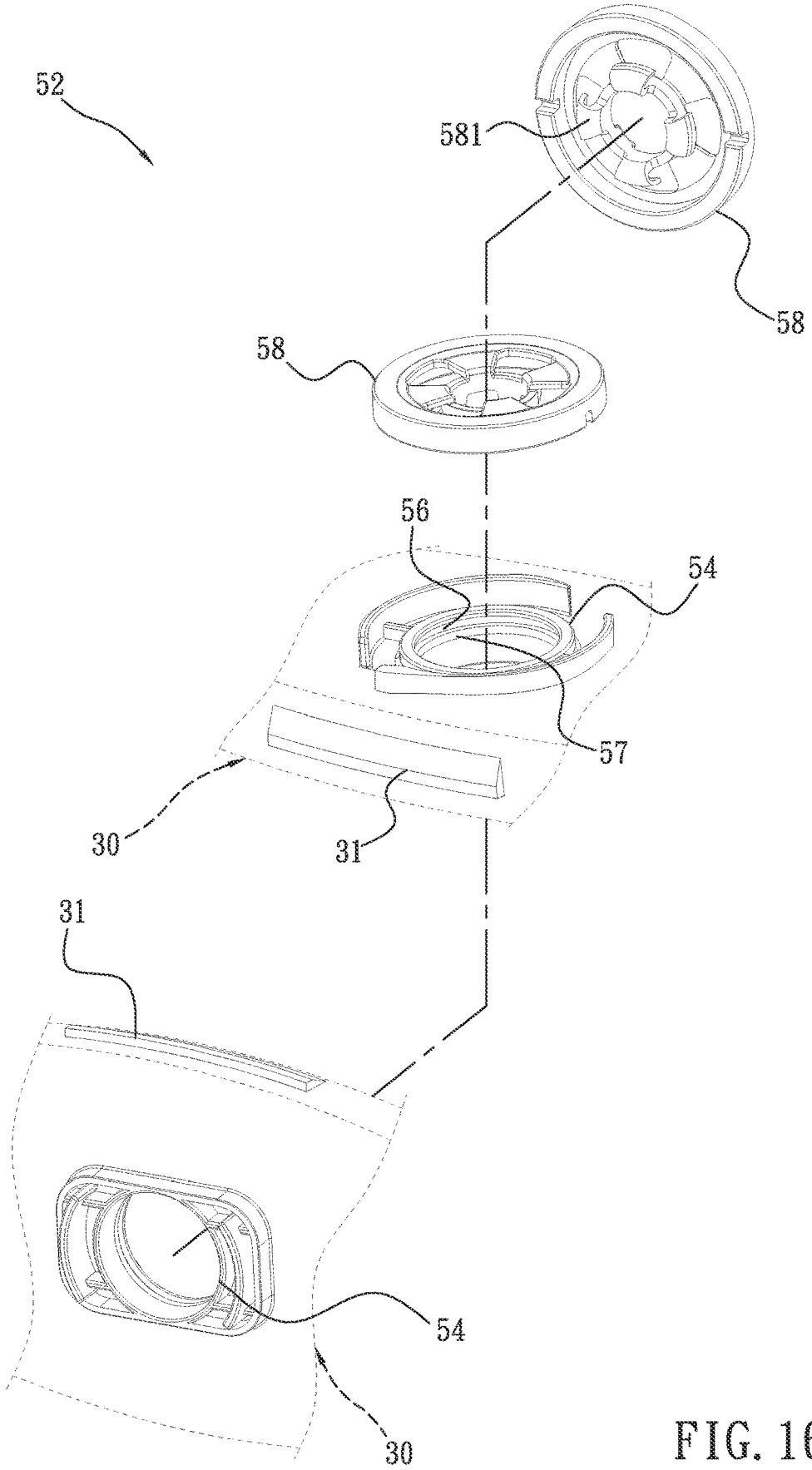
FIG. 16 is a partial enlarged view of the embodiment in FIG. 15 according to the present invention.
Figure 17:
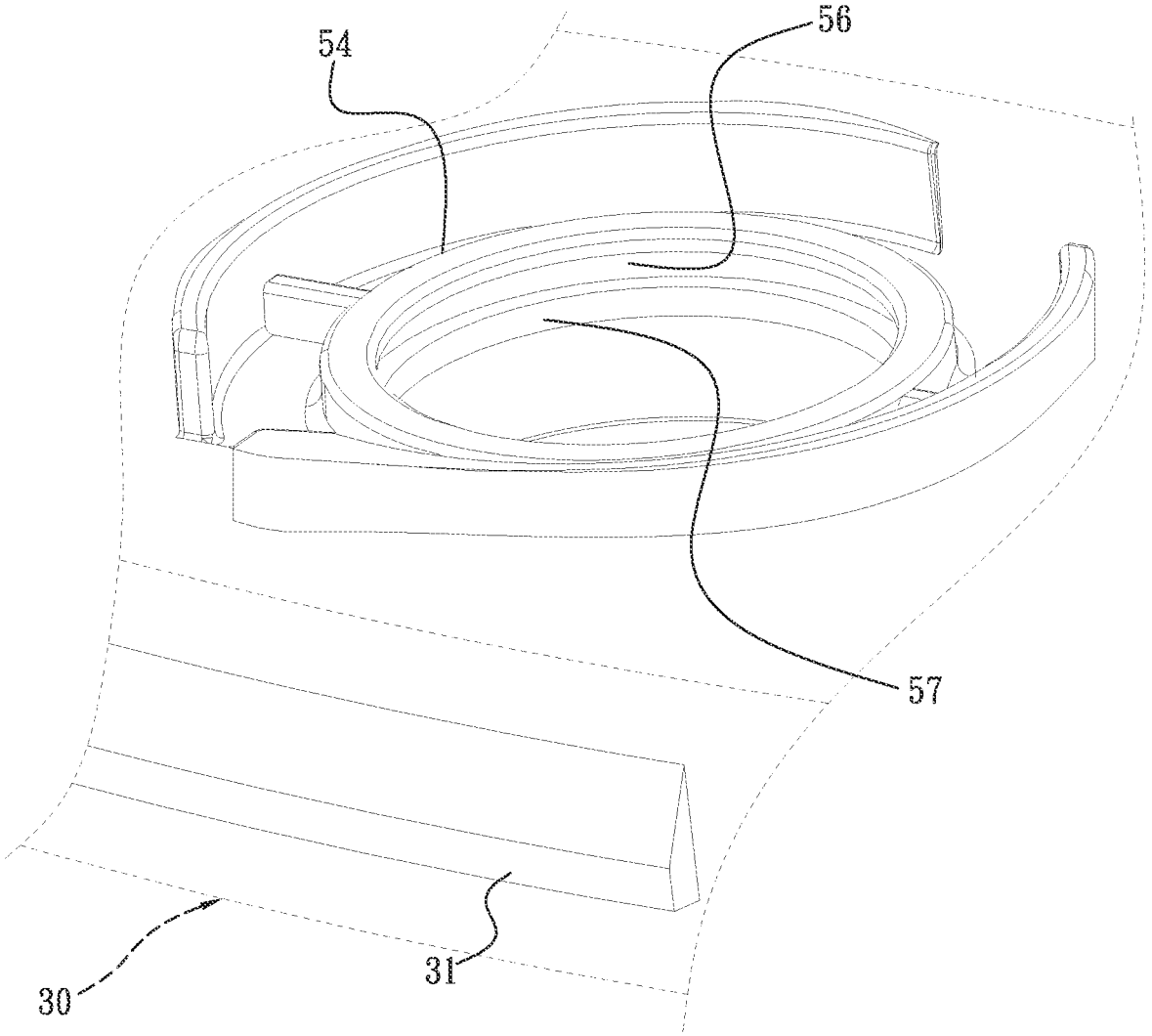
FIG. 17 is a partial enlarged view of a sleeve of the embodiment in FIG. 16 according to the present invention.
Figure 18:
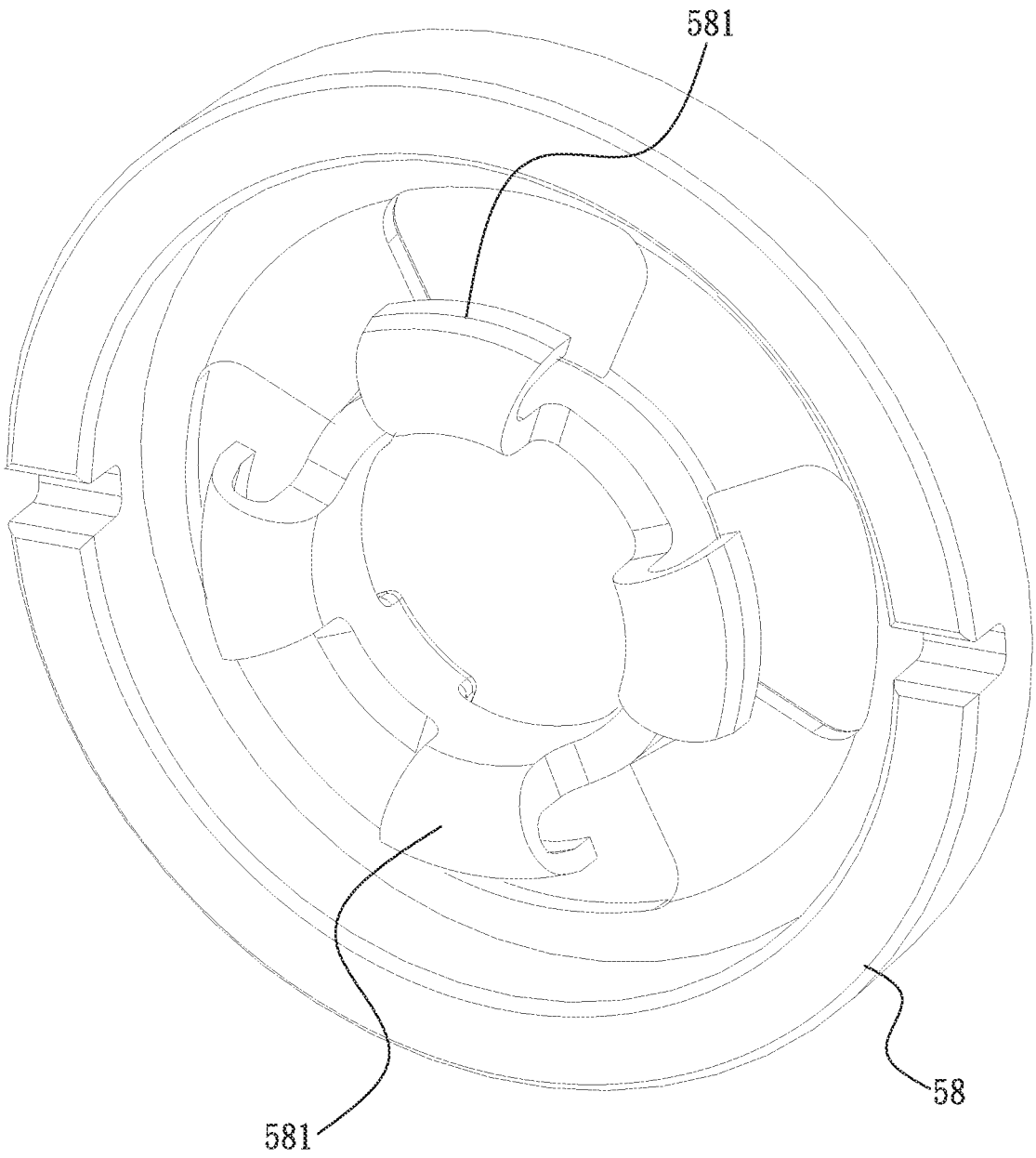
FIG. 18 is a partial enlarged view of a packing member of the embodiment in FIG. 16 according to the present invention.
Figure 19:
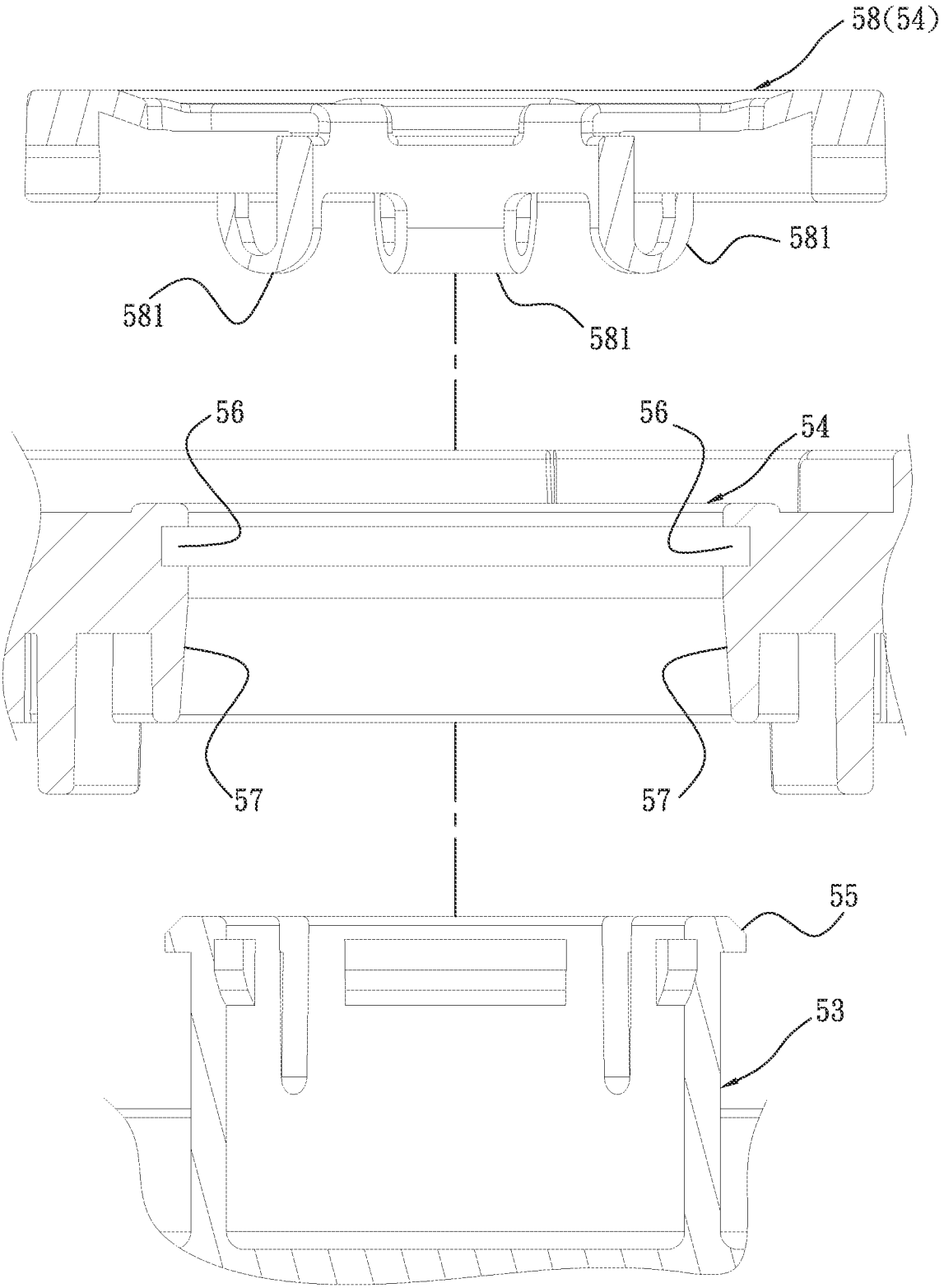
FIG. 19 is an exploded, side sectional view of a shaft tube, a sleeve, and a packing member of a second embodiment according to the present invention.
Figure 20:
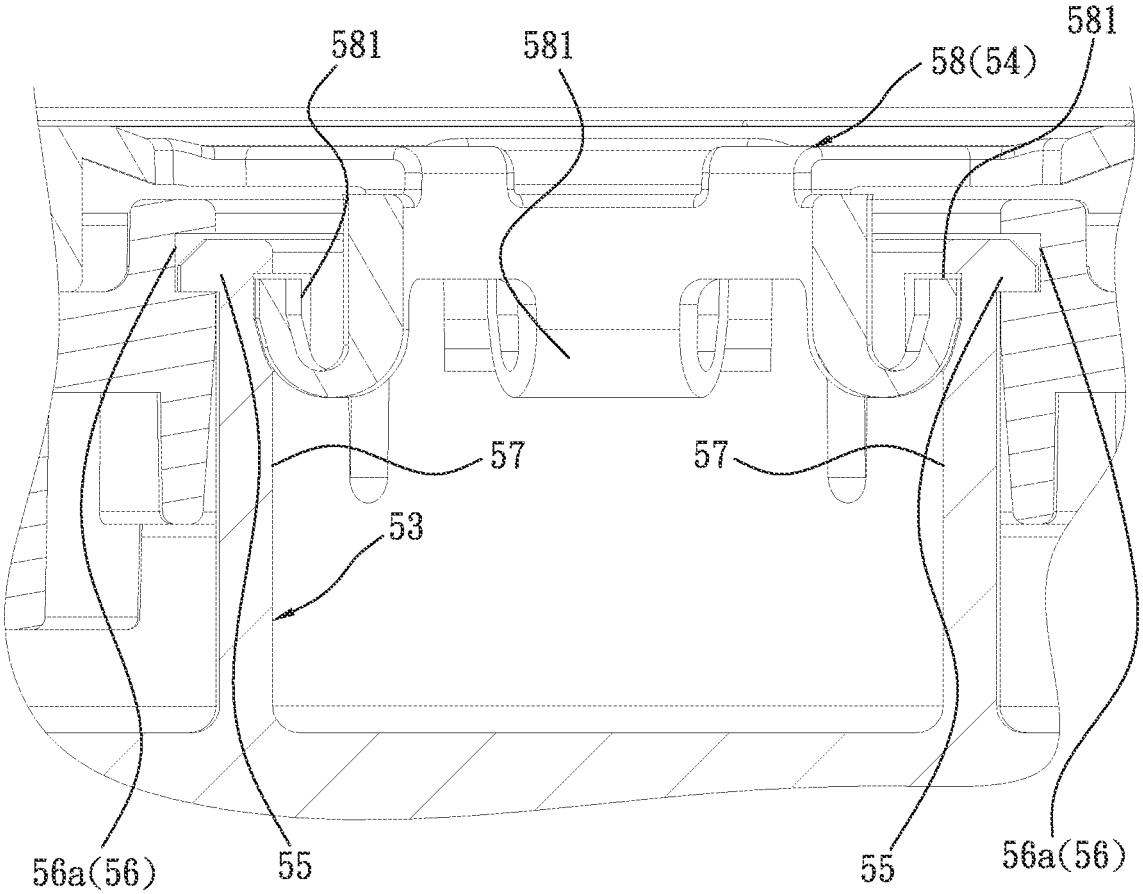
FIG. 20 is a partial enlarged sectional view of the embodiment in FIG. 19 in which a second fastening portion is a locking groove mounted to an inner circular surface according to the present invention.
Figure 21:
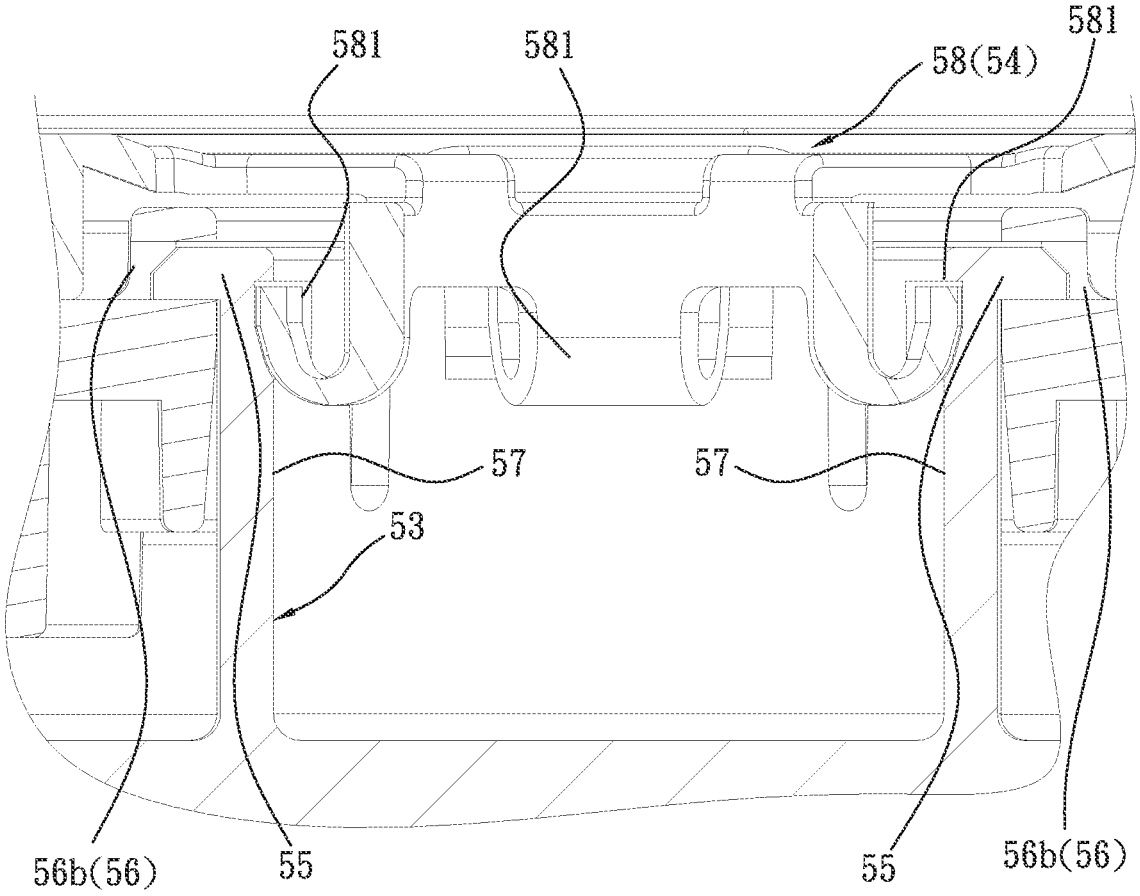
FIG. 21 is a partial enlarged sectional view of the embodiment in FIG. 19 in which a second fastening portion is an insertion hole located at an inner circular surface according to the present invention.
Figure 23:
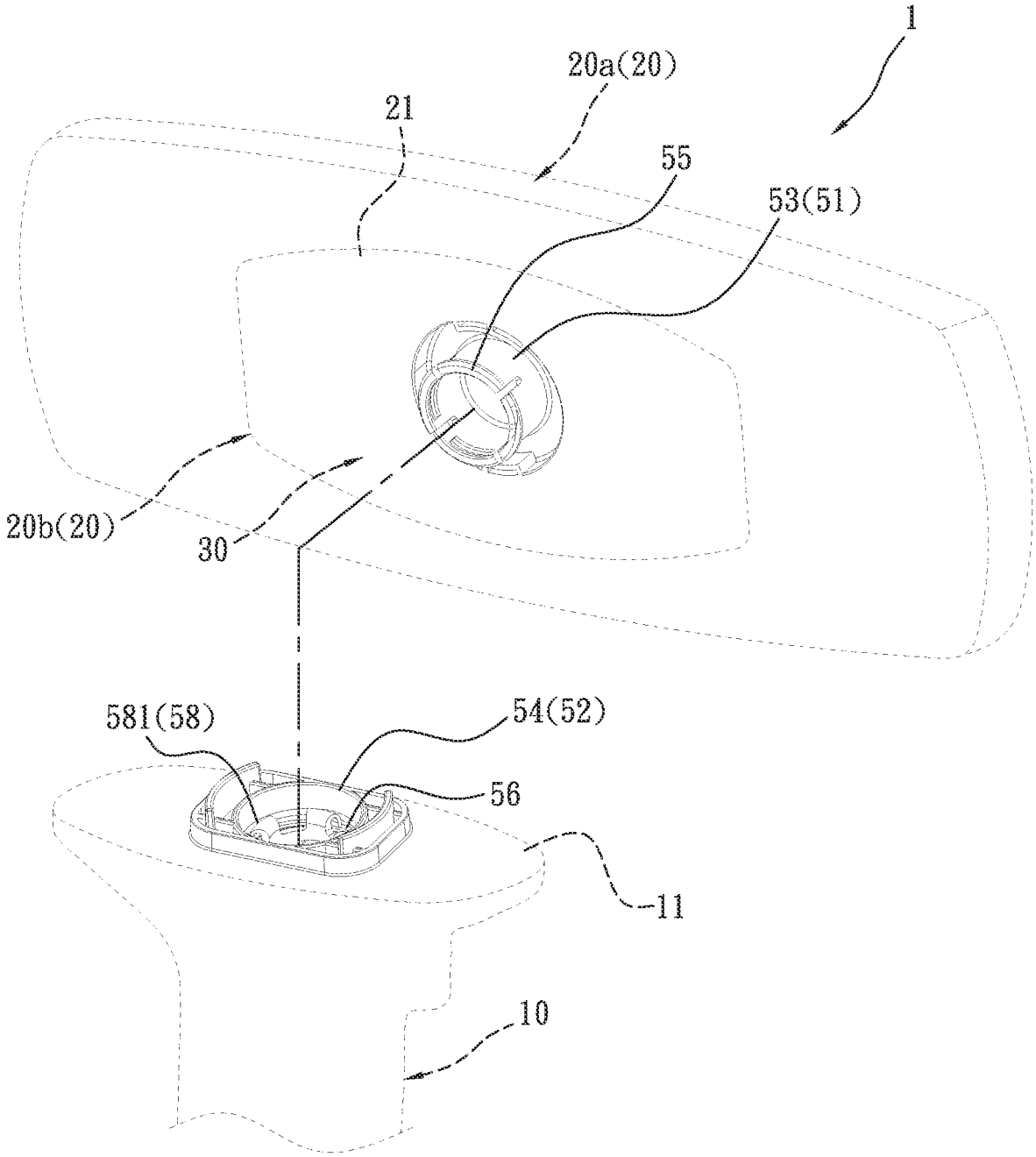
FIG. 23 is an exploded view of another embodiment (second embodiment) in which a shaft tube is aligned with a sleeve according to the present invention.

Refer to FIG. 14-23, a second embodiment of the chair armrest 1 according to the present invention is revealed. In this embodiment, the connecting member 50 includes at least one first connection portion 51 and at least one second connection portion 52 which are aligned and pressed to fit and connect with each other vertically, as shown in FIG. 14 and FIG. 23. One of the first connection portion 51 and the second connection portion 52 is disposed on the top support surface 11 while the other is arranged at the connection body 30 and positions of the first connection portion 51 and the second connection portion 52 are corresponding to each other. The first connection portion 51 and the second connection portion 52 are respectively a shaft tube 53 provided with a first fastening portion 55 and a sleeve 54 provided with a second fastening portion 56 corresponding to the first fastening portion 55. The shaft tube 53 and the sleeve 54 are affixed together by the first fastening portion 55 fastened with the second fastening portion 56, as shown in FIG. 20-22. The second fastening portion 56 of the sleeve 54 is located at an inner circular surface 57 inside the sleeve 54, as shown in FIG. 16, FIG. 17, and FIG. 19.

As shown in FIG. 14 and FIG. 23, while being assembled into the chair armrest, the armrest support 10 and the connection body 30 are connected to each other by the first connection portion 51 and the second connection portion 52 which are aligned and pressed to fit and connect with each other vertically. The armrest support 10 and the armrest pad body 20 are connected into one part by the connection body 30.

Refer to FIG. 15, FIG. 16, FIG. 18, and FIG. 19, the sleeve 54 further includes, but not limited to, a packing member 58 which is mounted to the connection body 30 and located above the sleeve 54. The packing member 58 is provided with at least two packing sheets 581, as shown in FIG. 19. The first fastening portion 55 of the shaft tube 53 is located on one end of the shaft tube 53, as shown in FIG. 19. When the first fastening portion 55 is fastened with the second fastening portion 56, the first fastening portion 55 of the shaft tube 53 is pressed by compressive force of the two packing sheets 581 of the packing member 58 and forced to lock into the second fastening portion 56, as shown in FIG. 20-22.

Moreover, the first connection portion 51 and the second connection portion 52 can be arranged at either the armrest support 10 or connection body 30 and corresponding to each other according to users' needs. As to the embodiment shown in FIG. 14, the first connection portion 51 is integrally formed and projecting from, but not limited to, the top support surface 11 of the armrest support 10 while the second connection portion 52 is arranged at, but not limited to, the bottom surface of the connection body 30.

By contrast, in the embodiment show in FIG. 23, the first connection portion 51 is disposed on, but not limited to, the bottom surface of the connection body 3 while the second connection portion 52 is integrally formed and projecting from, but not limited to, the top support surface 11 of the armrest support 10 for more diverse manufacturing and applications. Except the changes of the positions of the first connection portion 51 and the second connection portion 52, the rest structure or technical features are about the same in the above embodiments.

Refer to FIG. 20, FIG. 21, and FIG. 22, the second fastening portion 56 is, but not limited to, a locking groove **56*a* mounted to the inner circular surface 57 (as shown in FIG. 20), an insertion hole 56*b* located at the inner circular surface 57 (as shown in FIG. 21), or a surface 56*c* at one end of the inner circular surface 57 (as shown in FIG. 22**).

Refer to FIG. 18, the two packing sheets 581 of the packing member 58 are, but not limited to, claw-shaped with an interval therebetween for providing higher pressing force to other structure.

Figure 12:
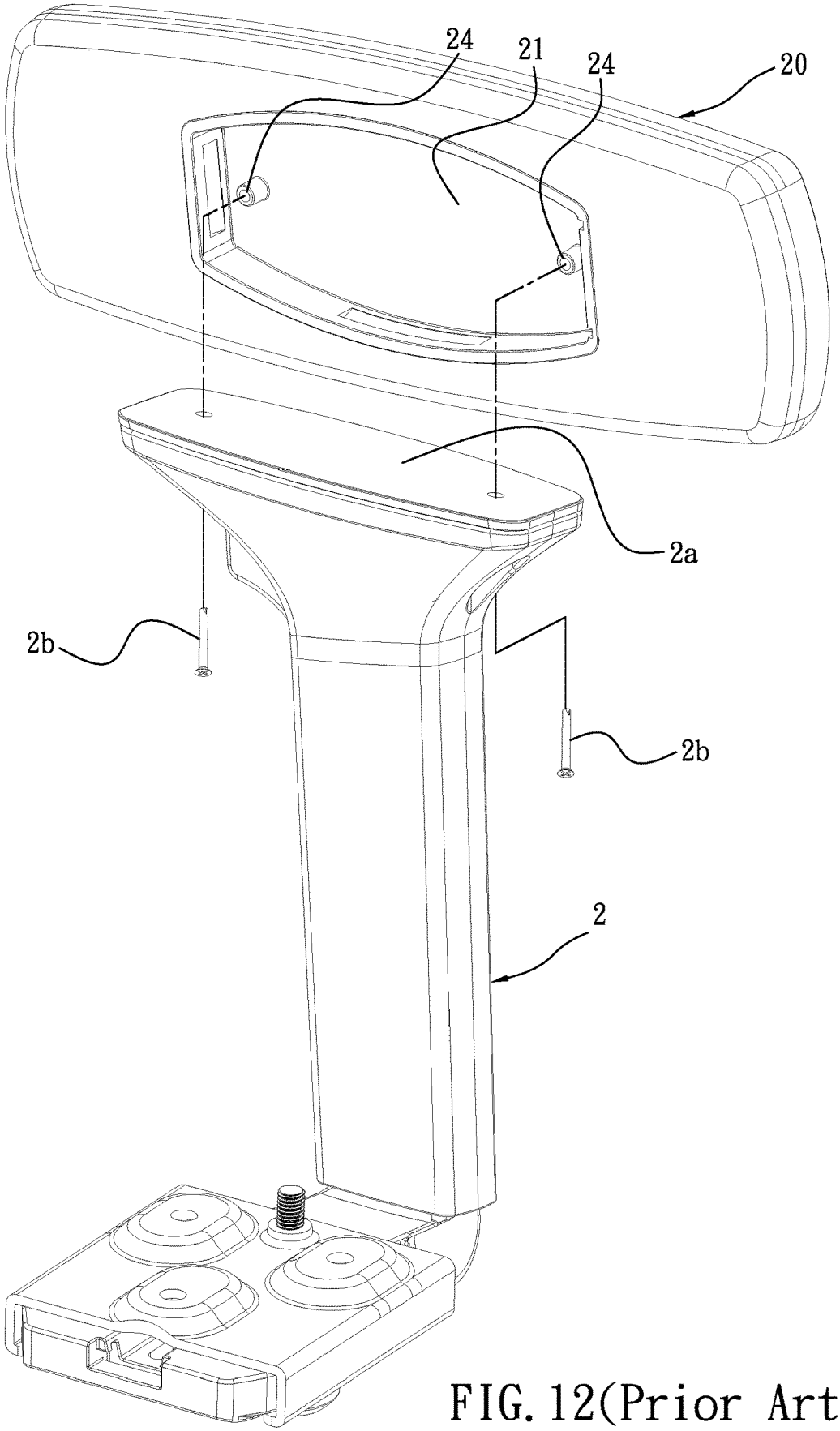
FIG. 12(Prior Art)
FIG. 12 is an exploded view of an assembly of an armrest pad with an armrest support available now.
Figure 13:
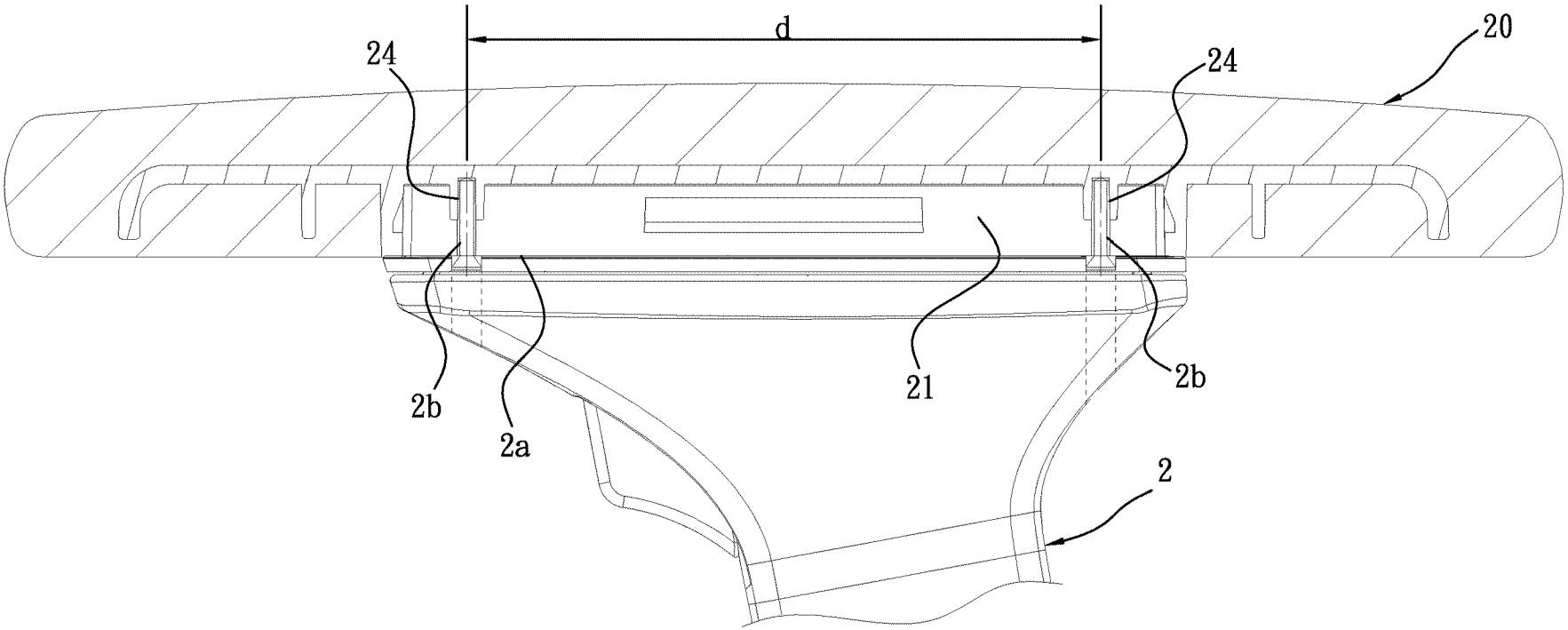
FIG. 13(Prior Art)
FIG. 13 is a sectional view of the assembly of an armrest pad with an armrest support available now shown in FIG. 12.

Compared with the chair armrest available now, the chair armrest 1 of the present invention has the following advantages: The armrest pad body 20 of the present invention includes the mounting slot with the opening facing downward, the depth and the shape thereof. The thickness and the shape of the connection body 30 are corresponding to the depth and the shape of the mounting slot 21 of the armrest pad body 20 so that the connection body 30 of the chair armrest 1 can be mounted and positioned in the mounting slot 21. The armrest support 10 and the connection body 30 are connected by the connecting member 40 or the connecting member 50 to solve the problem of the armrest pad body of the chair armrest available now that is only able to be used in combination with limited types of armrest supports. As shown in FIG. 12 and FIG. 13, the present armrest pad body 20 not only can be assembled and fastened with the armrest support 2 available now through the original fastening holes 24, but also can be combined with the connection body 30 and assembled with a new armrest support such as the present armrest support 10 by the connecting member 40 or the connecting member 50, as shown in FIG. 2, FIG. 11, FIG. 14, and FIG. 23. For manufacturers, they don't need to develop and produce new armrest pad body used in combination the armrest support without using fasteners during assembly. The design reduces the manufacturing cost.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A chair armrest comprising:

an armrest support having a top support surface which is formed on a top of the armrest support and provided with a lengthwise central axis;

an armrest pad body disposed on the top support surface of the armrest support and having a mounting slot which is provided with an opening facing downward and arranged at a bottom surface of the armrest pad body while the mounting slot having a depth and a shape thereof includes an inner bottom surface and a mounting wall surface;

a connection body which is mounted between the armrest support and the armrest pad body and provided with a thickness and a shape corresponding to the depth and the shape of the mounting slot so that the connection body is able to be mounted and positioned in the mounting slot; and a connecting member which includes a first connection portion and a second connection portion connected to each other vertically; one of the first connection portion and the second connection portion is disposed on the armrest support while the other of the first connection portion and the second connection portion is arranged at the connection body and positions of the first connection portion and the second connection portion are corresponding to each other; wherein the first connection portion includes a fastening head with a thickness in a vertical direction and a fastening neck connected to one side of the fastening head while the second connection portion is provided with a fastening hole and a locking slot which is having a depth in the vertical direction and communicating with an inner side of the fastening hole;

wherein shape and an area of a horizontal cross section of the fastening hole are respectively a bit larger than a shape and an area of a horizontal cross section of the fastening head so that the fastening head is able to be vertically mounted in the fastening hole and then located in the locking slot; wherein a shape and an area of a horizontal cross section of the locking slot is larger than and including the shape and the area of the horizontal cross section of the fastening head so that the locking slot further includes at least one travel area compared with the fastening head; thereby the fastening head is able to be rotated horizontally along the travel area and further stopped and positioned at a stop position of the respective travel area after vertically mounted into the locking slot; wherein when the fastening hole and the fastening head are aligned with each other vertically, the fastening head is able to be mounted into the locking slot through the fastening hole vertically and the fastening head and the fastening hole are in a first assembled state; wherein a lengthwise central axis of the first connection portion and the lengthwise central axis of the top support surface of the armrest support are in a staggered manner horizontally with a staggered angle therebetween when the fastening head and the fastening hole are in the first assembled state; wherein the fastening head is able to be rotated horizontally around a vertical central axis of the fastening neck in the locking slot when the fastening head and the fastening hole are in the first assembled state; wherein when the fastening head is rotated the staggered angle in the locking slot and stopped rotating, the fastening head is stopped and positioned at the stop position of the travel area and the fastening head and the fastening hole are in a second assembled state and the armrest support and the armrest pad body are fastened with each other into one part;

wherein the armrest support and the connection body are connected by vertical connection of the first connection portion with the second connection portion and the armrest pad body is affixed with the armrest support into one part by the connection body while being assembled into the chair armrest;

wherein the mounting wall surface of the armrest pad body is further provided with a locking recess; wherein a lateral side of the connection body is provided with a locking member able to be locked and fixed in the locking recess; wherein the connection body is mounted in the mounting slot by the locking member locked and fixed in the locking recess.

2. The chair armrest as claimed in claim 1, wherein the inner bottom surface of the armrest pad body further includes two fastening holes which are symmetrical to each other, having a distance between the two fastening holes, and provided with openings facing downward.

3. The chair armrest as claimed in claim 1, wherein the armrest pad body is composed of an armrest pad and an armrest member.

4. The chair armrest as claimed in claim 3, wherein the armrest pad is a soft elastic body formed outside the armrest member by integrally foamed technique.

5. The chair armrest as claimed in claim 1, wherein the first connection portion is integrally projecting from the top support surface of the armrest support; wherein the second connection portion is arranged at the bottom surface of the connection body.

6. The chair armrest as claimed in claim 1, wherein the first connection portion is integrally projecting from the bottom surface of the connection body; wherein the second connection portion is disposed on the top support surface of the armrest support.

7. A chair armrest comprising:

an armrest support having a top support surface which is formed on a top of the armrest support and provided with a lengthwise central axis;

an armrest pad body disposed on the top support surface of the armrest support and having a mounting slot which is provided with an opening facing downward and arranged at a bottom surface of the armrest pad body while the mounting slot having a depth and a shape thereof includes an inner bottom surface and a mounting wall surface;

a connection body which is mounted between the armrest support and the armrest pad body and provided with a thickness and a shape corresponding to the depth and the shape of the mounting slot so that the connection body is able to be mounted and positioned in the mounting slot; and a connecting member includes at least one first connection portion and at least one second connection portion which are aligned and pressed to fit and connect with each other vertically; one of the first connection portion and the second connection portion is disposed on the armrest support while the other is arranged at the connection body and positions of the first connection portion and the second connection portion are corresponding to each other; the first connection portion and the second connection portion are respectively a shaft tube provided with a first fastening portion and a sleeve provided with a second fastening portion corresponding to the first fastening portion; the shaft tube and the sleeve are joined together by the first fastening portion fastened with the second fastening portion; wherein the second fastening portion of the sleeve is located at an inner circular surface inside the sleeve;

wherein when being assembled into the chair armrest, the armrest support and the connection body are connected to each other by the first connection portion and the second connection portion which are aligned and pressed to fit and connect with each other vertically; the armrest pad body and the armrest support are connected into one part by the connection body.

8. The chair armrest as claimed in claim 7, wherein the inner bottom surface of the armrest pad body further includes two fastening holes which are symmetrical to each other, having a distance between the two fastening holes, and provided with openings facing downward.

9. The chair armrest as claimed in claim 7, wherein the armrest pad body is composed of an armrest pad and an armrest member.

10. The chair armrest as claimed in claim 9, wherein the armrest pad is a soft elastic body formed outside the armrest member by integrally foamed technique.

11. The chair armrest as claimed in claim 7, wherein the mounting wall surface of the armrest pad body is further provided with a locking recess; wherein a lateral side of the connection body is provided with a locking member able to be locked and fixed in the locking recess; wherein the connection body is mounted in the mounting slot by the locking member locked and fixed in the locking recess.

12. The chair armrest as claimed in claim 7, wherein the sleeve further includes a packing member which is mounted to the connection body and located above the sleeve; the packing member includes at least two packing sheets; wherein the first fastening portion of the shaft tube is located on one end of the shaft tube; wherein the first fastening portion of the shaft tube is pressed by compressive force of the two packing sheets of the packing member and forced to lock into the second fastening portion when the first fastening portion and the second fastening portion are fastened with each other.

13. The chair armrest as claimed in claim 7, wherein the first connection portion is integrally projecting from the top support surface of the armrest support; wherein the second connection portion is arranged at the bottom surface of the connection body.

14. The chair armrest as claimed in claim 7, wherein the first connection portion is integrally projecting from the bottom surface of the connection body; wherein the second connection portion is disposed on the top support surface of the armrest support.

15. The chair armrest as claimed in claim 7, wherein the second fastening portion is a locking groove mounted to the inner circular surface, an insertion hole located at the inner circular surface, or a surface at one end of the inner circular surface.

16. The chair armrest as claimed in claim 7, wherein the two packing sheets are claw-shaped and having an interval therebetween.

* * * * *